US005230978A

United States Patent [19]

Kawasaki et al.

[11] Patent Number: 5,230,978

[45] Date of Patent: Jul. 27, 1993

[54] ELECTROPHOTOGRAPHIC TONER COMPOSITION

[75] Inventors: Shoji Kawasaki, Yokohama; Nobuhiro Hirayama, Hiratsuka; Kenji Uchiyama, Odawara; Hisatomo Sato, Yokohama; Hiromi Akiyama, Hiratsuka, all of Japan

[73] Assignee: Mitsui Toatsu Chemicals, Incorporated, Tokyo, Japan

[21] Appl. No.: 741,537

[22] PCT Filed: Dec. 19, 1990

[86] PCT No.: PCT/JP90/01652

§ 371 Date: Aug. 14, 1991

§ 102(e) Date: Aug. 14, 1991

[87] PCT Pub. No.: WO91/09348

PCT Pub. Date: Jun. 27, 1991

[30] Foreign Application Priority Data

Dec. 19, 1989 [JP] Japan ..... 1-327274

[51] Int. Cl.[5] ..... G03G 9/087

[52] U.S. Cl. ..... 430/106; 430/110; 430/109; 430/904

[58] Field of Search ..... 430/904, 109, 114, 137, 430/106

[56] References Cited

U.S. PATENT DOCUMENTS 4,626,488 12/1986 Inoue ..... 430/109

FOREIGN PATENT DOCUMENTS 62-91959 6/1987 Japan .
63-17461 1/1988 Japan .
63-56661 4/1988 Japan .

*Primary Examiner*—Marion E. McCamish
*Assistant Examiner*—Rosemary Ashton
*Attorney, Agent, or Firm*—Oblon, Spivak, McClelland, Maier & Neustadt

[57] ABSTRACT

Disclosed herein is an electrophotographic toner composition produced by using a low-melt-viscosity and high-strength resin. The present invention provides a toner which fixes at low heat and has high strength and therefore, is suitable for high-speed copying machines and lower-heat copying machines. The resultant benefits of the present invention are that the lowest limit of the fixing temperature is low, non-offset range is wide and picture properties are good. The electrophotographic toner composition can, therefore, provide stable pictures even when fixed at low heat.

10 Claims, No Drawings

ELECTROPHOTOGRAPHIC TONER COMPOSITION

DESCRIPTION

1. Technical Field

This invention relates to an electrophotographic toner composition.

2. Background Art

In electrophotography, the copying speed has tended to increase in recent years to meet the ever increasing quantity of information to be dealt with. In a high-speed copying machine, the heat transmitted from a fixing hot roll is low compared with a medium-speed copying machine; as well, the surface temperature of the fixing hot roll falls appreciably because more heat absorbed by the paper than can be fully compensated for. Accordingly, there is a demand for a toner composition which can be fixed at low heat and does not cause an offset problem at this lower level of fixing temperature.

On the other hand, copying machines have become smaller, and the pressure and temperature of a fixing roll have lowered. In this field, the development and improvement of developers with good fixing properties and offset resistance even at low heat have also been conducted.

For example, there is known a process disclosed in Japanese Patent Publication No. 6895/1980 which provides a toner having good offset resistance using, as a resin for the developer, a resin having a weight-average molecular weight/number-average molecular weight ratio of 3.5–40 and a number-average molecular weight of 2,000–30,000; and also a process disclosed in Japanese Patent Laid-Open No. 101031/1974 which widens the range of fixing temperature and provides a toner free from offset problems even at a comparatively high fixing temperature by using a crosslinked resin.

It has been found, however, that whereas the prior art as described above is effective for the conventional copying machine troubled with an offset problem, a sufficient effect cannot be obtained in the case of a copying machine which uses a lower heat for fixing. Namely, this is presumed to result from the improvements that have been made in order to increase the weight-average molecular weight of the resin to achieve an improvement in the strength of the toner and offset resistance.

The resins described above have such a high viscosity that they are not suitable in their conventional form for the lower-heat fixing copying machines. Viscosity reduction of the resin by lowering its weight-average molecular weight, however, tends to damage the offset resistance or the picture quality as the result of a long-term operation of the image.

DISCLOSURE OF THE INVENTION

An object of the present invention is to solve all the problems of the prior art and to provide a toner, which fixes at lower-heat levels and is excellent in strength, suitable for a recently-developed high-speed copying machine or lower-heat copying machine.

In accordance with the process of the present invention, an electrophotographic toner composition which always produces stable and good-quality pictures when fixed at lower heat levels is provided, which has not been actualized by the prior art. The resultant benefits of the present invention are that the lowest limit of the fixing temperature is low, non-offset range is wide and picture properties are remarkably good. It has, thus, excellent properties as an electrophotographic toner composition.

BEST MODE FOR CARRYING OUT THE INVENTION

Based on the finding that the problems described above can be eliminated by using a low-melt-viscosity and high-strength resin to produce a toner, the present inventors have completed the present invention.

Namely, the present invention provides an electrophotographic toner composition comprising as a principal component a polymer obtained by continuously adding dropwise or adding in portions, to 100 parts by weight (all designations of "part" indicate "part by weight" unless otherwise specifically indicated) of an ethylenically-unsaturated monomer or a solution composed of 100 parts of an ethylenically-unsaturated monomer and x parts of a solvent, a solution mixture composed of 0.01–30 parts of a divinyl compound, y parts of a solvent and 0.01–10 parts of a polymerization initiator, in which x plus y are at least 20 parts but not larger than 200 parts or y is at least 20 parts but not larger than 200 parts.

In the present invention, a divinyl compound may be used preferably in an amount of 0.01–30 parts per 100 parts of an ethylenically-unsaturated monomer, with 0.05–20 parts being particularly preferred. If the amount is smaller than 0.01 part, the strength of the resin drops, which results in the deterioration of its fixing properties. If the amount exceeds 30 parts, on the other hand, an increase in the resin viscosity and reduction in melt property lead to the deterioration of its lower-heat fixing property.

In the present invention, the total amount of the solvent(s), that is, x plus y or y is 20–200 parts. If the amount is smaller than 20 parts, a viscosity increase occurs during polymerization and it becomes difficult to control the polymerization reaction. Moreover, the molecular weight becomes greater, which results in deterioration in the melt property of the resin and also in its lower-heat fixing property. Any amounts greater than 200 parts, on the other hand, are not preferable from the viewpoint of reduction in productivity.

The polymerization initiator is preferably used in an amount of 0.01–10 parts in the present invention. The amount of the polymerization initiator brings about a large effect on the molecular weight of the resin. Any amounts smaller than 0.01 part result in an increase in the molecular weight and also viscosity. Accordingly, it becomes difficult to conduct the reaction control. Owing to the increase in the viscosity, a toner composition containing such an amount of the polymerization initiator is not suitable for a lower-heat fixing copying machines. Any amounts greater than 10 parts result in a decrease in the molecular weight and deterioration in offset resistance. In addition, lowering the resin strength decreases both the fixing strength fixing property.

Examples of the ethylenically unsaturated monomer usable in the present invention includes acrylic acid esters such as methyl acrylate, ethyl acrylate, propyl acrylate, butyl acrylate, octyl acrylate, cyclohexyl acrylate, lauryl acrylate, stearyl acrylate, benzyl acrylate, furfuryl acrylate, tetrahydrofurfuryl acrylate, hydroxyethyl acrylate, hydroxybutyl acrylate, dimethylaminomethyl acrylate ester, and dimethylaminoethyl acrylate ester; methacrylic acid esters such as methyl methacrylate, ethyl methacrylate, propyl methacrylate, butyl methacrylate, octyl methacrylate, lauryl methacrylate, stearyl methacrylate, cyclohexyl methacrylate, benzyl methacrylate, furfuryl methacrylate, tetrahydrofurfuryl methacrylate, hydroxyethyl methacrylate, hydroxypropyl methacrylate, hydroxybutyl methacrylate, dimethylaminomethyl methacrylate ester, and dimethylaminoethyl methacrylate ester; aromatic vinyl monomers such as vinyltoluene, α-methylstyrene, chlorostyrenes, and styrene; dialkyl esters of unsaturated dibasic acids such as dibutyl maleate, dioctyl maleate, dibutyl fumarate, and dioctyl fumarate; vinyl esters such as vinyl acetate and vinyl propionate; nitrogen-containing vinyl monomers such as acrylonitrile and methacrylonitrile; unsaturated carboxylic acids such as acrylic acid, methacrylic acid and cinnamic acid; unsaturated dicarboxylic acids such as maleic acid, maleic anhydride, fumaric acid, and itaconic acid; monoester of unsaturated dicarboxylic acids such as monomethyl maleate, monoethyl maleate, monobutyl maleate, monooctyl maleate, monomethyl fumarate, monoethyl fumarate, monobutyl fumarate and monooctyl fumarate; styrenesulfonic acid; acrylamide; methacrylamide; N-substituted acrylamide; N-substituted methacrylamide; and acrylamidopropanesulfonic acid. At least one monomer is selected from the monomers illustrated above. Among these, acrylic acid esters, methacrylic acid esters, styrene, dialkyl fumarate esters, acrylonitrile, methacrylic acid, cinnamic acid, monoesters of fumaric acid, acrylic acid, acrylamide, methacrylamide and the like are particularly preferred.

As a divinyl compound, a compound copolymerizable with the ethylenically-unsaturated monomer illustrated above can be used in the present invention. Examples of it include aromatic divinyl compounds such as divinylbenzene, divinylnaphthalene and derivatives thereof; and aliphatic divinyl compounds such as (poly)ethyleneglycol diacrylate and (poly)ethyleneglycol dimethacrylate.

As a solvent usable in the present invention, aromatic hydrocarbons such as benzene, toluene, ethylbenzene, orthoxylene, metaxylene, paraxylene and cumene are used either singly or in combination. It is however possible to choose one or more other solvents for use.

In the present invention, any polymerization initiator usable as a radical polymerization initiator can be used in general. Examples of the polymerization initiator include azo initiators such as 2,2'-azobis-isobutyronitrile, 2,2'-azobis(4-methoxy-2,4-dimethylvaleronitrile), 2,2'-azobis(-2,4-dimethylvaleronitrile), 2,2'-azobis(2-methylbutyronitrile), dimethyl-2,2'-azobisisobutylate, 1,1'-azobis(1-cyclohexanecarbonitrile), 2-(carbamoylazo)-isobutyronitrile, 2,2'-azobis(2,4,4-trimethylpentane, 2-phenylazo-2,4-dimethyl-4-methoxyvaleronitrile, and 2,2'-azobis(2-methylpropane); ketone peroxide, acetylacetone peroxide and cyclohexanone peroxide; peroxyketals such as 1,1-bis(t-butylperoxy)-3,3,5-trimethylcyclohexane, 1,1-bis(butylperoxy)cyclohexane and 2,2-bis(t-butylperoxy)butane; hydroperoxides such as t-butyl hydroperoxide, cumene hydroperoxide, and 1,1,3,3-tetramethyl hydroperoxide; dialkyl peroxides such as di-t-butyl peroxide, t-butylcumyl peroxide, di-cumyl peroxide, 2,5-dimethyl-2,5-di(t-butylperoxy)hexane, and α,α'-bis(t-butyl peroxyisopropyl)benzene; diacyl peroxides such as isobutyryl peroxide, octanoyl peroxide, decanoyl peroxide, lauroyl peroxide, 3,3,5-trimethylhexanoyl peroxide, benzoyl peroxide, and m-toluoyl peroxide; peroxycarbonates such as di-isopropylperoxydicarbonate, di-2-ethylhexylperoxydicarbonate, di-n-propylperoxydicarbonate, di-2-ethoxyethylperoxycarbonate, di-methoxyisopropylperoxydicarbonate, and di(3-methyl-3methoxybutyl)peroxycarbonate; sulfonyl peroxides such as acetylcyclohexylsulfonyl peroxide; peroxy esters such as t-butyl peroxyacetate, t-butyl peroxyisobutylate, t-butyl peroxyneodecanoate, cumyl peroxy-neodecanoate, t-butyl peroxy-2-ethylhexanoate, t-butyl peroxybenzonoate, t-butyl peroxyisopropylcarbonate, and di-t-butyl peroxyisophthalate. The kind and amount of the initiator can be suitably selected, depending on the reaction temperature, monomer concentrations or the like. In general, the polymerization initiator may be added in an amount of 0.01–10 parts per 100 parts of the ethylenically unsaturated monomer.

The continuous dropwise addition or addition in portions may be conducted over 1–20 hours in the present invention. It is, however, desirable to employ continuous dropwise addition because in the case of the addition in portions, the concentration of the polymerization initiator or the like shows a large variation and therefore, production stability can not be maintained. Further, the dropwise addition is preferably conducted over 1–10 hours from the viewpoint of productivity.

The polymer obtained according to the above-described manner may be added, if needed, with a part of an additive such as polyvinyl chloride, polyolefins, polyesters, polyvinyl butyral, polyurethanes, polyamides, rosin, terpene resins, phenol resins, epoxy resins, paraffin wax and polyolefin wax to an extent not impairing the effects of the present invention.

In the present invention, a colorant is used ordinarily. Examples of the colorant include black pigments such as carbon black, acetylene black, lamp black, and magnetite; and pigments known to date such as chrome yellow, yellow iron oxide, Hansa yellow G, quinoline yellow lake, Permanent Yellow NCG, molybdenum orange, Vulcan orange, Indanthrenes, Brilliant Orange GK, red iron oxide, Brilliant Carmine 6B, flizarin lake, methyl violet lake, Fast Violet B, cobalt blue, alkali blue lake, phthalocyanine blue, Fast Sky Blue, Pigment Green B, malachite green lake, titanium oxide and zinc white. The colorant is generally used in an amount of 5–300 parts per 100 parts of the polymer.

The toner composition according to the present invention may be selectively added, for example, with a known charge control agent such as nigrosin, a quaternary ammonium salt, a metal-containing azo pigments and metallic salts of aliphatic acid or a pigment dispersant, an offset inhibitor and the like and may then be converted into a toner by a method known per se in the art. For example, the resultant polymer mixture with the above various additives incorporated therein is premixed, kneaded in a heated and melted state in a kneader, cooled, comminuted finely by means of a jet pulverizer, and then classified by a classifier to collect particles, generally, in a range of 8–20 μm as a toner.

EXAMPLES

The present invention will hereinafter be described specifically by the following examples. It should however be borne in mind that this invention is by no means limited to or by the examples.

PRODUCTION EXAMPLE 1

To a 4-necked 5 l flask, a cooling tube, a thermometer, a nitrogen inlet tube and a stirrer were attached. In this flask, 70 parts of styrene and 30 parts of n-butyl acrylate were charged. They were heated to 130° C. while introducing nitrogen. Then, the reaction mixture was continuously added dropwise with 0.01 part of divinylbenzene, 100 parts of xylol and 5 parts of azoisobutyronitrile over 5 hours. The polymerization rate at that time was 87%. As the result of the reaction continued for further 5 hours at the temperature maintained at 130° C., the polymerization rate was found to become 98%. The resin solution thus obtained was subjected to solvent removal, whereby a toner resin [A] was obtained.

PRODUCTION EXAMPLE 2

Resin [B] was obtained as in Production Example 1 except that the amount of divinylbenzene was increased to 0.05 part.

PRODUCTION EXAMPLE 3

Resin [C] was obtained as in Production Example 1 except that the amount of divinylbenzene was increased to 0.50 part.

PRODUCTION EXAMPLE 4

Resin [D] was obtained as in Production Example 1 except that the amount of divinylbenzene was increased to 1.00 part.

PRODUCTION EXAMPLE 5

Resin [E] was obtained as in Production Example 1 except that the amount of divinylbenzene was increased to 5.00 parts.

PRODUCTION EXAMPLE 6

Resin [F] was obtained as in Production Example 1 except that the amount of divinylbenzene was increased to 10.0 parts.

PRODUCTION EXAMPLE 7

Resin [G] was obtained as in Production Example 1 except that the amount of divinylbenzene was increased to 20.0 parts.

PRODUCTION EXAMPLE 8

Resin [H] was obtained as in Production Example 1 except that the amount of divinylbenzene was increased to 30.0 parts.

COMPARATIVE PRODUCTION EXAMPLE 1

Resin [1] was obtained as in Production Example 1 except that divinylbenzene was not added.

COMPARATIVE PRODUCTION EXAMPLE 2

Resin [2] was obtained as in Production Example 1 except that the amount of divinylbenzene was decreased to 0.008 part.

COMPARATIVE PRODUCTION EXAMPLE 3

Resin [3] was obtained as in Production Example 1 except that the amount of divinylbenzene was increased to 32.0 parts.

COMPARATIVE PRODUCTION EXAMPLE 4

Resin [4] was obtained as in Production Example 1 except that the amount of divinylbenzene was increased to 35.0 parts.

EXAMPLES 1–8, COMPARATIVE EXAMPLES 1–4

Toner was produced in the following manner, using each of the resins described above.

In a Henschel mixer, 100 parts of the above resin, 10 parts of carbon black (MA-100: produced by Mitsubishi Kasei Corporation), 5 parts of polypropylene wax and 1 part of nigrosine dye as a charge control agent were premixed. The resultant premixture was kneaded in a twin-screw kneader at a temperature of 170° C. (predetermined temperature). The mass so formed was cooled, crushed, pulverized and then classified by a classifier, whereby a toner having a particle size of 8–20μ was produced.

The fixing property, offset resistance, blocking resistance, picture quality and the like of the thus-obtained toner were evaluated. For the evaluation of the fixing property and offset resistance, a commercially-available copying machine which had been remodelled so that the rolling temperature could be changed optionally was used.

The results are shown in Table 1.

In the Table, 70% fixing temperature indicates the lowest hot roll temperature necessary for the weight residual ratio of the toner layer to exceed 70% after the toner layer of a 2 cm×2 cm solid black area on the picture was rubbed twenty times by an eraser under a load of 125 g/cm$^2$ using a rubbing tester of the Japan Society for Promotion of Scientific Research.

Low-temperature offset means the temperature at which offset begins to occur as the result of the gradual lowering in the temperature of the fixing roll.

High-temperature offset means the temperature at which offset begins to occur as the result of the gradual increase in the temperature of the fixing roll.

The picture quality was evaluated by visually judging the 50,000th copy. The results were ranked in accordance with the following standard:

A: Very clear picture without fog.

B: No problems in practical use, though the picture is slightly dim or has a little fogging.

C: Less legible to see with shading-off or fogging.

D: Impossible to use because of indistinct picture with severe fogging and offset.

TABLE 1

| | Resin used | 70% Fixing temperature (°C.) | Low-temperature offset (°C.) | High-temperature offset (°C.) | Picture quality |
|---|---|---|---|---|---|
| Example 1 | A | 130 | 110 | 180 | B |
| Example 2 | B | 130 | 115 | 190 | A |
| Example 3 | C | 135 | 110 | 205 | A |
| Example 4 | D | 140 | 115 | 215 | A |
| Example 5 | E | 140 | 110 | 220< | A |
| Example 6 | F | 150 | 125 | 220< | A |
| Example 7 | G | 155 | 125 | 220< | A |
| Example 8 | H | 160 | 130 | 220< | B |
| Comp. Ex. 1 | 1 | 130 | 120 | 150 | D |
| Comp. Ex. 2 | 2 | 130 | 115 | 170 | C |
| Comp. Ex. 3 | 3 | 170 | 140 | 220< | C |
| Comp. Ex. 4 | 4 | 185 | 155 | 220< | D |

PRODUCTION EXAMPLE 9

To a 4-necked 5 l flask, a cooling tube, a thermometer, a nitrogen inlet tube and a stirrer were attached. In this flask, 70 parts of styrene and 30 parts of n-butyl acrylate were charged. They were heated to 130° C. while introducing nitrogen. Then, the reaction mixture was continuously added dropwise with 5 parts of divinylbenzene, 100 parts of xylol and 5 parts of azoisobutyronitrile over 5 hours. The polymerization rate at that time was 88%. As the result of the reaction continued for further 5 hours at the temperature maintained at 130° C., the polymerization rate was found to increase to 98%. The resin solution thus obtained was subjected to solvent removal, whereby a toner resin [I] was obtained.

PRODUCTION EXAMPLE 10

Resin [J] was obtained as in Production Example 9 except that the amount of xylol was changed to 50 parts.

PRODUCTION EXAMPLE 11

Resin [K] was obtained as in Production Example 9 except that the amount of xylol was decreased to 90 parts.

PRODUCTION EXAMPLE 12

Resin [L] was obtained as in Production Example 9 except that the amount of xylol was increased to 200 parts.

COMPARATIVE PRODUCTION EXAMPLE 5

Resin [5] was obtained as in Production Example 9 except that the amount of xylol was decreased to 10 parts.

COMPARATIVE PRODUCTION EXAMPLE 6

Resin [6] was obtained as in Production Example 9 except that the amount of xylol was decreased to 18 parts.

COMPARATIVE PRODUCTION EXAMPLE 7

Resin [7] was obtained as in Production Example 9 except that the amount of xylol was increased to 220 parts.

COMPARATIVE PRODUCTION EXAMPLE 8

Resin [8] was obtained as in Production Example 9 except that the amount of xylol was increased to 250 parts.

EXAMPLES 9-12, COMPARATIVE EXAMPLES 5-8

Toners were separately produced in exactly the same manner as in Examples 1-8 and Comparative Examples 1-4, which were described above, using the thus-obtained resins and they were subjected to evaluation.

Results are summarized in Table 2.

TABLE 2

| | Resin used | 70% Fixing temperature (°C.) | Low-temperature offset (°C.) | High-temperature offset (°C.) | Picture quality |
|---|---|---|---|---|---|
| Example 9 | I | 145 | 105 | 220< | A |
| Example 10 | J | 140 | 110 | 220< | A |
| Example 11 | K | 140 | 110 | 220< | A |
| Example 12 | L | 150 | 115 | 215 | A |
| Comp. Ex. 5 | 5 | 185 | 115 | 220< | D |
| Comp. Ex. 6 | 6 | 165 | 110 | 220< | C |
| Comp. Ex. 7 | 7 | 150 | 125 | 210 | C |
| Comp. Ex. 8 | 8 | 155 | 125 | 210 | D |

PRODUCTION EXAMPLE 13

To a 4-necked 5 l flask, a cooling tube, a thermometer, a nitrogen inlet tube and a stirrer were attached. In this flask, 70 parts of styrene and 30 parts of n-butyl acrylate were charged. They were heated to 130° C. while introducing nitrogen. Then, the reaction mixture was continuously added dropwise with 5 parts of divinylbenzene, 100 parts of xylol and 0.01 part of azobisisobutyronitrile over 5 hours. The polymerization rate at that time was 77%. As the result of the reaction continued for further 10 hours at the temperature maintained at 130° C., the polymerization rate was found to become 98%. The resin solution thus obtained was subjected to solvent removal, whereby a toner resin [M] was obtained.

PRODUCTION EXAMPLE 14

Resin [N] was obtained as in Production Example 13 except that the amount of azobisisobutyronitrile was changed to 0.05 part.

PRODUCTION EXAMPLE 15

Resin [O] was obtained as in Production Example 13 except that the amount of azobisisobutyronitrile was increased to 0.10 part.

PRODUCTION EXAMPLE 16

Resin [P] was obtained as in Production Example 13 except that the amount of azobisisobutyronitrile was increased to 0.50 part.

PRODUCTION EXAMPLE 17

Resin [Q] was obtained as in Production Example 13 except that the amount of azobisisobutyronitrile was increased to 1.00 part.

PRODUCTION EXAMPLE 18

Resin [R] was obtained as in Production Example 13 except that the amount of azobisisobutyronitrile was increased to 4.50 parts.

PRODUCTION EXAMPLE 19

Resin [S] was obtained as in Production Example 13 except that the amount of azobisisobutyronitrile was increased to 10.0 part.

COMPARATIVE PRODUCTION EXAMPLE 9

Resin [9] was obtained as in Production Example 13 except that the amount of azobisisobutyronitrile was changed to 0.005 part.

COMPARATIVE PRODUCTION EXAMPLE 10

Resin [10] was obtained as in Production Example 13 except that the amount of azobisisobutyronitrile was changed to 0.008 part.

COMPARATIVE PRODUCTION EXAMPLE 11

Resin [11] was obtained as in Production Example 13 except that the amount of azobisisobutyronitrile was changed to 11.0 parts.

COMPARATIVE PRODUCTION EXAMPLE 12

Resin [12] was obtained as in Production Example 13 except that the amount of azobisisobutyronitrile was changed to 13.0 parts.

EXAMPLES 13-19, COMPARATIVE EXAMPLES 9-12

In each Example, the polymerization rate after the continuous dropwise addition differed with a using amount of the polymerization initiator. The polymerization time was, therefore, prolonged when the polymerization rate was not sufficient. The polymerization times has no relationship with the physical properties of the toners, however, excessively long polymerization time is not preferred from the viewpoint of the manufacturing cost.

Toners were separately produced in exactly the same manner as in Examples 1-8 and Comparative Examples 1-4, which were described above, using the thus-obtained resins and they were evaluated.

Results are summarized in Table 3.

TABLE 3

| | Resin used | 70% Fixing temperature (°C.) | Low-temperature offset (°C.) | High-temperature offset (°C.) | Picture quality | Polymerization time (hr) |
|---|---|---|---|---|---|---|
| Example 13 | M | 155 | 120 | 220< | A | 30 |
| Example 14 | N | 150 | 120 | 220< | A | 25 |
| Example 15 | O | 150 | 115 | 220< | A | 20 |
| Example 16 | P | 145 | 115 | 220< | A | 16 |
| Example 17 | Q | 140 | 115 | 220< | A | 13 |
| Example 18 | R | 140 | 110 | 220< | A | 10 |
| Example 19 | S | 140 | 110 | 220 | B | 8 |
| Comp. Ex. 9 | 9 | 160 | 120 | 220 | B | 42 |
| Comp. Ex. 10 | 10 | 155 | 120 | 220 | B | 36 |
| Comp. Ex. 11 | 11 | 140 | 110 | 215 | C | 7 |
| Comp. Ex. 12 | 12 | 140 | 110 | 210 | C | 7 |

PRODUCTION EXAMPLE 20

To a 4-necked 5 l flask, a cooling tube, a thermometer, a nitrogen inlet tube and a stirrer were attached. In this flask, 70 parts of styrene, 30 parts of n-butyl acrylate and 20 parts of xylol were charged. They were heated to 130° C. while introducing nitrogen. Then, the reaction mixture was continuously added dropwise with 5 parts of divinylbenzene, 180 parts of xylol and 5 parts of azobisisobutyronitrile over 5 hours. The polymerization rate at that time was 84%. As the result of the reaction continued for further 6 hours at the temperature maintained at 130° C., the polymerization rate was found to become 98%. The resin solution thus obtained was subjected to solvent removal, whereby a toner resin [T] was obtained.

PRODUCTION EXAMPLE 21

Resin [U] was obtained as in Production Example 20 except that the amount of xylol charged in the flask was changed to 100 parts and that of xylol continuously added dropwise was also changed to 100 parts.

PRODUCTION EXAMPLE 22

Resin [V] was obtained as in Production Example 20 except that the amount of xylol charged in the flask was increased to 180 parts and that of xylol continuously added dropwise was decreased to 20 parts.

PRODUCTION EXAMPLE 23

Resin [W] was obtained as in Production Example 20 except that the amount of xylol charged in the flask was changed to 20 parts and that of xylol continuously added dropwise was changed to 80 parts.

PRODUCTION EXAMPLE 24

Resin [X] was obtained as in Production Example 20 except that the amount of xylol charged in the flask was changed to 50 parts and that of xylol continuously added dropwise was changed to 50 parts.

PRODUCTION EXAMPLE 25

Resin [Y] was obtained as in Production Example 20 except that the amount of xylol charged in the flask was changed to 80 parts and that of xylol continuously added dropwise was changed to 20 parts.

PRODUCTION EXAMPLE 26

Resin [Z] was obtained as in Production Example 20 except that the amount of xylol charged in the flask was changed to 5 parts and that of xylol continuously added dropwise was changed to 15 parts.

PRODUCTION EXAMPLE 27

Resin [Z2] was obtained as in Production Example 20 except that the amount of xylol charged in the flask was changed to 10 parts and that of xylol continuously added dropwise was changed to 10 parts.

PRODUCTION EXAMPLE 28

Resin [Z3] was obtained as in Production Example 20 except that the amount of xylol charged in the flask was changed to 15 parts and that of xylol continuously added dropwise was changed to 5 parts.

COMPARATIVE PRODUCTION EXAMPLE 13

Resin [13] was obtained as in Production Example 20 except that the amount of xylol charged in the flask was changed to 200 parts and that of xylol continuously added dropwise was changed to 20 parts.

COMPARATIVE PRODUCTION EXAMPLE 14

Resin [14] was obtained as in Production Example 20 except that the amount of xylol charged in the flask was changed to 10 parts and that of xylol continuously added dropwise was changed to 5 parts.

EXAMPLES 20-28, COMPARATIVE EXAMPLES 13-14

In each Example, the polymerization rate after the continuous dropwise addition differed with a using amount of the polymerization initiator. The polymerization time was, therefore, prolonged when the polymerization rate was not sufficient. The polymerization times has no relationship with the physical properties of the toners, however, excessively long polymerization time is not preferred from the viewpoint of the manufacturing cost.

Toners were separately produced in exactly the same manner as in Examples 1–8 and Comparative Examples 1–4, which were described above, using the thus-obtained resins and they were subjected to evaluation.

Results are summarized in Table 4.

TABLE 4

| | Resin used | 70% Fixing temperature (°C.) | Low-temperature offset (°C.) | High-temperature offset (°C.) | Picture quality | Polymerization time (hr) |
|---|---|---|---|---|---|---|
| Example 20 | T | 140 | 120 | 220 | A | 30 |
| Example 21 | U | 145 | 120 | 220 | A | 25 |
| Example 22 | V | 140 | 115 | 215 | A | 20 |
| Example 23 | W | 145 | 110 | 220< | A | 30 |
| Example 24 | X | 145 | 115 | 220< | A | 25 |
| Example 25 | Y | 145 | 110 | 220< | A | 20 |
| Example 26 | Z | 145 | 115 | 220< | A | 16 |
| Example 27 | Z2 | 150 | 115 | 220< | A | 13 |
| Example 28 | Z3 | 150 | 115 | 220< | A | 10 |
| Comp. Ex. 13 | 13 | 140 | 120 | 200 | C | 35 |
| Comp. Ex. 14 | 14 | 160 | 130 | 220 | C | 10 |

PRODUCTION EXAMPLE 29

Resin [Z4] was obtained as in Production Example 5 except that the solvent was changed to toluol and the polymerization temperature was changed to 110° C.

PRODUCTION EXAMPLE 30

Resin [Z5] was obtained as in Production Example 5 except that the solvent was changed to Solvesso (product of Esso Kagaku K.K.) and the polymerization temperature was changed to 120° C.

PRODUCTION EXAMPLE 31

Resin [Z6] was obtained as in Production Example 5 except that the composition of the monomer was changed to 60 parts of styrene and 40 parts of n-butyl methacrylate.

PRODUCTION EXAMPLE 32

Resin [Z7] was obtained as in Production Example 5 except that the composition of the monomer was changed to 50 parts of styrene, 20 parts of methyl methacrylate and 30 parts of 2-ethylhexyl acrylate.

PRODUCTION EXAMPLE 33

Resin [Z8] was obtained as in Production Example 5 except that the composition of the monomer was changed to 80 parts of methyl methacrylate and 20 parts of 2-ethylhexyl acrylate.

PRODUCTION EXAMPLE 34

Resin [Z9] was obtained as in Production Example 5 except that divinylbenzene was replaced by diethyleneglycol dimethacrylate.

PRODUCTION EXAMPLE 35

Resin [Z10] was obtained as in Production Example 5 except that divinylbenzene was replaced by tetraethyleneglycol diacrylate.

PRODUCTION EXAMPLE 36

Resin [Z11] was obtained as in Production Example 5 except that the continuous dropwise addition over 5 hours was changed to the addition in five portions for hours at hourly intervals.

COMPARATIVE PRODUCTION EXAMPLE 15

Resin [15] was obtained as in Production Example 5 except that the continuous dropwise addition over 5 hours was changed to the addition at once.

Resin [15] was obtained as in Production Example 5 except that the dropwise addition over 5 hours was changed to the addition at a time.

EXAMPLES 29–36, COMPARATIVE EXAMPLE 15

Toners were separately produced in exactly the same manner as in Examples 1–8 and Comparative Examples 1–4 which were described above, using the thus-obtained resins and they were evaluated.

Results are summarized in Table 5.

TABLE 5

| | Resin used | 70% Fixing temperature (°C.) | Low-temperature offset (°C.) | High-temperature offset (°C.) | Picture quality |
|---|---|---|---|---|---|
| Example 29 | Z4 | 150 | 120 | 220< | A |
| Example 30 | Z5 | 140 | 115 | 220< | A |
| Example 31 | Z6 | 140 | 110 | 220< | A |
| Example 32 | Z7 | 150 | 120 | 220< | A |
| Example 33 | Z8 | 140 | 115 | 220< | A |
| Example 34 | Z9 | 145 | 115 | 220< | A |
| Example 35 | Z10 | 140 | 115 | 220< | A |
| Example 36 | Z11 | 140 | 110 | 220< | A |
| Comp. Ex. 15 | 15 | 180 | 160 | 220< | C |

We claim:

1. An electrophotographic toner composition comprising as a principal component a polymer obtained by continuously adding dropwise or adding in portions, to 100 parts by weight of an ethylenically-unsaturated monomer or a solution composed of 100 parts by weight of an ethylenically unsaturated monomer and x parts by weight of a solvent, a solution composed of 0.01–30 parts by weight of a divinyl compound, y parts by weight of a solvent and 0.01–10 parts by weight of a polymerization initiator, in which x plus y are at least 20 parts by weight but not larger than 200 parts by weight or y is at least 20 parts by weight but not larger than 200 parts by weight.

2. The toner composition of claim 1, wherein the divinyl compound is added in an amount of 0.05–20 parts by weight based on 100 parts by weight of an ethylenically unsaturated monomer.

3. The toner composition of claim 1, wherein the ethylenically-unsaturated monomer is at least one monomer selected from the group consisting of acrylic esters, methacrylic esters, styrene, dialkyl fumarates, acrylonitrile, methacrylic acids, cinammic acid, fumaric monoesters, acrylic acids, acrylamide and methacrylamide.

4. The toner composition of claim 1, wherein the divinyl compound is at least one compound selected from the group consisting of aromatic divinyl compounds such as divinylbenzene, divinylnaphthalene, and derivatives thereof and aliphatic vinyl compounds such as (poly)ethyleneglycol diacrylate and (poly)ethyleneglycol dimethacrylate.

5. The toner composition of claim 1, wherein the solvent is at least one solvent selected from the group consisting of benzene, toluene, ethylbenzene, orthoxylene, metaxylene, paraxylene and cumene.

6. The toner composition of claim 1, wherein the polymer is obtained by the continuous dropwise addition of a monomer solution mixture over 1-10 hours.

7. The toner composition of claim 1, wherein the polymer further comprises at least one additive selected from the group consisting of polyvinyl chloride, polyolefins, polyesters, polyvinyl butyral, polyurethane, polyamide, rosin, terpene resins, phenol resins, epoxy resins, paraffin wax and polyolefin wax.

8. The toner composition of claim 1, wherein the polymer further comprises at least one colorant selected from the group consisting of carbon black, acetylene black, lamp black, magnetite, chrome yellow, yellow iron oxide, Hansa yellow G, quinoline yellow lake, Permanent Yellow NCG, molybdenum orange, Vulcan orange, Indanthrenes, Brilliant Orange GK, red iron oxide, Brilliant Carmine 6B, flizarin lake, methyl violet lake, Fast Violet B, cobalt blue, alkali blue lake, phthalocyanine blue, Fast Sky Blue, Pigment Green B, malachite green lake, titanium oxide and zinc white.

9. The toner composition of claim 8, wherein the amount of the colorant is 5-300 parts by weight based on 100 parts by weight of the polymer.

10. The toner composition of claim 1, wherein the polymer further comprises at least one additive selected from the group consisting of charge control agents such as nigrosin, quaternary ammonium salt, metal-containing azo pigments; metallic salts of aliphatic acid; pigment dispersants; and offset inhibitors.

* * * * *